United States Patent [19]

Rossopoulos

[11] Patent Number: 4,758,847

[45] Date of Patent: Jul. 19, 1988

[54] ELECTROTHERMAL PRINTER

[75] Inventor: Stephane Rossopoulos, Yverdon, Switzerland

[73] Assignee: Hermes Precisa International S.A., Yverdon, Switzerland

[21] Appl. No.: 911,399

[22] Filed: Sep. 25, 1986

[30] Foreign Application Priority Data

Sep. 25, 1986 [CH] Switzerland ..... 1140/85

[51] Int. Cl.[4] ..... E01D 15/10; B41J 3/20

[52] U.S. Cl. ..... 346/76 PH; 346/76 R; 346/151; 400/120; 400/124; 400/208; 400/232

[58] Field of Search ..... 346/76 PH, 76 R, 155, 346/152; 400/120, 208, 232, 124

[56] References Cited

U.S. PATENT DOCUMENTS

| | | | |
|---|---|---|---|
| 4,236,834 | 12/1980 | Hafer et al. | 400/120 |
| 4,309,117 | 1/1982 | Chang et al. | 400/241.1 |
| 4,350,452 | 9/1982 | Dials et al. | 400/208 |
| 4,516,137 | 5/1985 | Yasui | 346/76 PH |

*Primary Examiner*—E. A. Goldberg
*Assistant Examiner*—Gerald E. Preston
*Attorney, Agent, or Firm*—Gifford, Groh, VanOphem, Sheridan, Sprinkle and Dolgorukov

[57] ABSTRACT

An electrothermal printer having a print head provided with a plurality of wire electrodes, an ink ribbon, and a heating ribbon separate from the ink ribbon. The heating ribbon is in the form of a layer of material which is a poor conductor of electricity and a layer of electrically conductive material. The current passing between one or several of the electrodes in the print head to the heating ribbon conductive layer which is in contact with an appropriate sliding contact or electrode heats a localized area, or localized areas, of the heating ribbon which in turn transfers heat to corresponding localized areas of the ink ribbon for transferring ink on a sheet of paper. The ink ribbon and the heating ribbon are displaced at the same speed past the print head. The printer of the invention permits high rate printing at a relatively low cost of supplies. With the ink ribbon omitted, printing can be effected directly on thermo-sensitive paper.

9 Claims, 1 Drawing Sheet

ELECTROTHERMAL PRINTER

BACKGROUND OF THE INVENTION

The invention relates to an electrothermal printer in general. More particularly, the invention relates to a thermal printer provided with an ink ribbon and a heating ribbon independent of the ink ribbon, and with a print head having a plurality of electrodes, the electrodes in the print head and a second electrode being connected across an electrical power supply such as to provide selective heating of the inked ribbon.

Electrothermal printers are disclosed for example in U.S. Pat. Nos. 3,744,611 and 4,456,915. Thermal printers having electrodes incorporated in the print head require the use of complex ink ribbons, provided at least with a layer of high electrical resistance, a layer conductive of electricity and a layer of ink. The manufacturing cost of such ribbons is consequently relatively high, resulting in a high utilization cost for such a thermal printer. Because, in addition, the electrically conductive layer is generally sandwiched between the ink layer and the layer of low electrical conductivity, the heating electrical current is forced to pass twice through the layer of low conductivity. Furthermore, such thermal printers are not adapted to direct printing on thermal sensitive paper.

Another type of thermal printer, described for example in European patent application No. 0086661, is provided with a print head having miniature heating elements, or microresistors, directly heating a simple ink ribbon of low cost. Such print heads are however subjected to considerable heating and are incapable of supplying high power. The printing speed is, consequently, lower than the speed of thermal printers having electrode print heads. In addition, thermal printers of this type have limited application only on smooth paper. The manufacturing cost of microresistors print heads is very high.

Electrothermal printers provided with electrode printing heads are also known, as disclosed in U.S. Pat. No. 4,268,368, which use an ink ribbon which is reinked after being used once for printing. Such a structure leads to complex and costly printers.

SUMMARY OF THE INVENTION

The present invention has for its principal object to remedy the inconveniences of electrothermal printers of the prior art by providing a printer of simple structure, of relatively low utilization cost, but nevertheless provided with a high printing speed.

The present invention has for principal object to provide an electrothermal printer having heating means comprising a heating ribbon independent of the ink ribbon and capable of being displaced relative to the print head, the heating ribbon being inserted during printing between the electrodes carried by the print head and the ink ribbon, the heating ribbon being made of a material such that electric current flowing through the heating ribbon heats the heating ribbon in proximity of the electrodes, the heating ribbon being separated from the ink ribbon after printing, and appropriate feeding means being provided for displacing the ink ribbon relative to the print head.

The advantages of the invention are principally to provide an electrothermal printer which is characterized by a high printing speed as a result of utilizing an electrode print head, and which can be operated at a low cost as a result of utilizing a simple ink ribbon. As the heating ribbon and the ink ribbon are translated at the same speed relative to the print head, the ink ribbon is not subjected to friction and can be as thin as desired, thus requiring a relatively small storage space and providing a precise ink transfer.

A better understanding of the invention will result from a reading of the following best mode contemplated at the present for practicing the invention, in conjunction with the accompanying drawing wherein:

DETAILED DESCRIPTION OF THE PREFERRED EMBODIMENT

Figure 1:
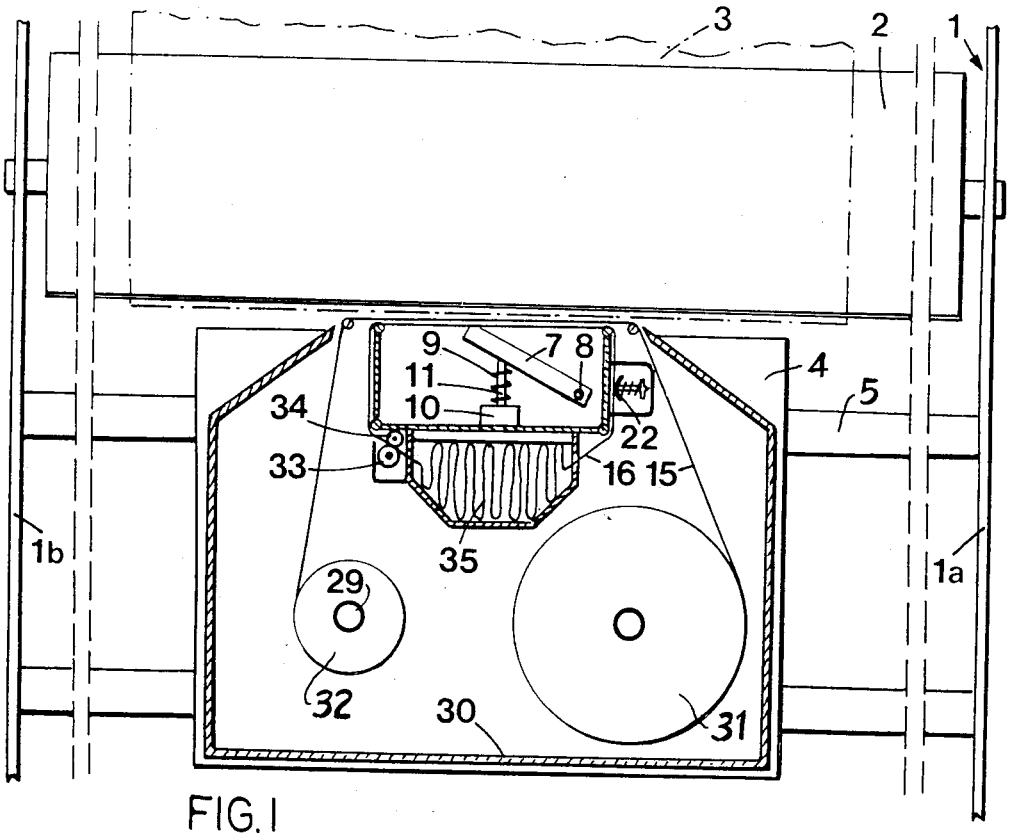
FIG. 1 is a plan view of a printer according to the invention, with the cover of the ribbon cartridge being removed.

The electrothermal printer schematically illustrated at FIG. 1 comprises a frame 1 having lateral walls 1a and 1b, a drum 2 providing a printing support for a sheet of paper or envelope 3 and a carriage 4 slidably mounted on a pair of transverse bars 5 and 6 for displacement along the axis of the cylinder 2 by appropriate driving means, well known and not illustrated.

A print head 7 is pivotally supported from a pivot pin 8, attached to the carriage 4, and is urged by a spring 9 towards the cylinder 2. An electromagnet 10 mounted on the carriage 4 and having a reciprocable rod 11 attached to the print head 7 is arranged to pull the tip of the print head 7 away from the drum 2.

Figure 2:
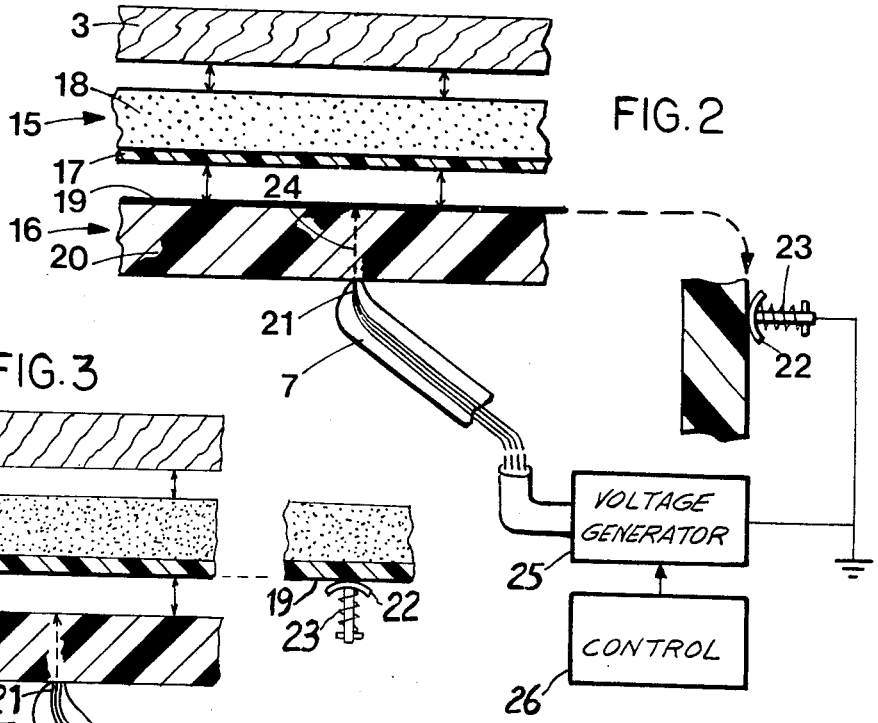
FIG. 2 is a schematic detailed view in section illustrating the function of the printer.

The printer has two ribbons 15 and 16, the ribbon 15 being a conventional ink ribbon having a base 17, FIG. 2, preferably made of plastic, and a coating of ink 18, for example an ink having a wax base and capable of being transferred to a sheet of paper when heated. It will be appreciated that other ink ribbons, for example monocoat ink ribbons, may also be used. As illustrated in detail and in an exaggerated fashion at FIG. 2, the second ribbon 16 which, in combination with the print head, provides the heating means, is made of a layer 19 which is highly conductive of electricity and of a layer 20 which is poorly conductive of electricity, for example a polyimide base 20 on which a metallic coating 19 has been applied by vacuum deposition in order to form a conductive coating.

The print head 7 has an array of wire electrodes 21 ending flush with the frontal portion of the print head and arranged to engage the base or coating 20 of the heating ribbon 16. The electrodes 21 are preferably arranged in one or several vertical rows. A second electrode 22, in the form of a sliding contact, is mounted on the carriage 4, FIG. 1, and urged by a spring 23 against the conductive coating 19. A voltage generator 25 controlled by an electronic control unit 26 permits an application a voltage differential between any one, or any number, of the wire electrodes 21 and the electrode 22. The electrical current flowing across the low conductivity coating 20 of the heating ribbon 16 heats the coating 20 by resistance heating in a zone 24, FIG. 2, limited substantially to a straight line between an electrode 21 in the print head 7 and the electrically conductive coating 19, the current return to the voltage generator 25 being effected through the common electrode or contact 22 constantly in engagement with the conductive coating 19. The ink ribbon 15 in engagement with the conductive coating 19 of the heating ribbon 16 is thus locally heated in a corresponding area for transferring ink on a limited area of the sheet 3.

As illustrated at FIG. 1, the ink ribbon 15 and the heating ribbon 16 are disposed in a cartridge 30. The ink ribbon 15, which has a length substantially longer, at least five times, for example one hundred times longer, than the length of the heating ribbon 16, is unwound from a supply reel 31 and wound on a take-up reel 32, and it is fed past the print head 7 by appropriate drive means 24 driving the take-up reel 32 in rotation.

The heating ribbon 16 forms a closed loop. It is driven by a pair of rollers 33 and 34 and is stored in a compartment 35 of the cartridge 30. The second electrode or contact 22 acts as a braking means for the heating ribbon 16. The drive means 29, 33 and 34 are arranged such that the ink ribbon 15 and the heating ribbon 16 are displaced at the same speed relative to the print head 7.

During printing, the print head 7 applies the ink ribbon 15, the heating ribbon 16 and the sheet 3 against the drum 2. The control unit 26 controls the voltage generator 25 selectively such as to apply voltage to predetermined wire electrodes 21 in the print head 7. While the carriage 4 and the print head 7 are displaced, the two ribbons 15 and 16 remain stationary relative to the drum 2 and the sheet 3. The tip of the print head 7 thus continuously engages renewed areas of the heating ribbon 16 and is thus not subjected to any parasitical heating. As the current conductive coating 19 of the heating ribbon 16 is in direct contact with the second electrode or contact 22, the heating current encounters only the resistance of the poorly conductive layer 20, even for relatively small voltage differential.

It will be appreciated by those skilled in the art that the invention, as described, is subject to many modifications within the scope of the appended claims and that the description of the structure has been given for illustrative purposes only and not in a limiting sense. For example, the heating ribbon, as described and as illustrated, can be replaced by a member or sheet independent of the ink ribbon and adapted to be displaced past the print head at the same speed as the ink ribbon, such as a sheet held laterally between a pair of bifurcated holders.

Figure 3:
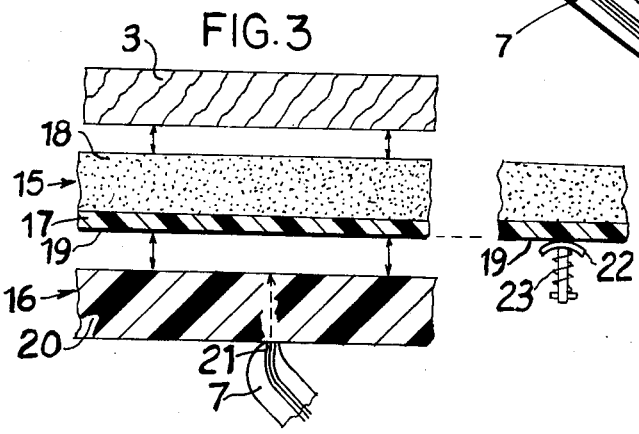
FIG. 3 is a view similar to FIG. 2, but showing a modification thereof.

Also, the conductive coating 19 could be applied to the ink ribbon 15, instead of being applied to the heating ribbon 16, and the second electrode or contact 22 engaged with the conductive coating on the ink ribbon, as shown schematically at FIG. 3.

The printer could also be modified to the type provided with a stationary print head, non-movable laterally relative to the print support, for example for simultaneous printing of a full line.

Furthermore, the printer of the invention is particularly well adapted for printing on thermo-sensitive paper. The ink ribbon 15 is obviously not needed and is omitted, or pushed out of the way by appropriate means, not shown, when printing on thermo-sensitive paper, and the heating ribbon 16 is directly inserted between the print head 7 and the thermo-sensitive paper replacing the plain paper 3, transferring heat directly onto the thermo-sensitive paper.

Having thus described the present invention by way of an example of structure for practicing the invention, modifications whereof will be apparent to those skilled in the art, what is claimed as new is as follows:

1. An electrothermal printer comprising: a print support for supporting a sheet to be printed; an ink ribbon disposed adjacent to said sheet; and means for heating selected and localized areas of the ink ribbon for transferring ink from said selected and localized areas to the sheet, said heating means comprising, a print head having an array of electrodes urged towards said print support and at least one second independent electrode, said print head electrode and said second electrode being connected across a voltage source, a heating ribbon disposed between said print head and said ink ribbon, said heating ribbon spaced apart from said ink ribbon and being adapted for localized heating at selected areas corresponding to the location of the print head electrode being energized, means for moving said portion of said heating ribbon into and out of contact with said ink ribbon during printing by heat transfer of ink from said ink ribbon to said sheet, and means for displacing said heating ribbon independently of said ink ribbon at a speed equal to the speed of said ink ribbon relative to said print head.

2. The printer of claim 1 wherein said second ribbon comprises a first layer of electrically conductive material and a second layer of relative poorly conductive material, said second layer being disposed engageable with said print head for resistive heating of portions of said second layer by passage of current from said print head electrodes to said highly conductive layer.

3. The printer of claim 2 wherein said second electrode is engaged with said first layer during printing.

4. The printer of claim 1 wherein said ink ribbon and said second ribbon are contained in a single cartridge.

5. The printer of claim 1 where said ink ribbon has a length which is at least five times that of said second ribbon.

6. The printer of claim 4 wherein the ink ribbon has a length which is at least five times that of the second ribbon.

7. The printer of claim 1 where said ink ribbon is unwound from a supply reel and is wound on a take-up reel after use, and said second ribbon is a closed loop.

8. The printer of claim 1 wherein said ink ribbon has an electrically conductive coating engageable with said heating ribbon during printing, said electrically conductive coating being engaged with said second electrode during printing, and wherein said heating ribbon is made of electrically poorly conductive material.

9. The printer of claim 1 further comprising means for printing a thermo-sensitive print sheet said means for printing including means for displacing said ink ribbon from a first position between said heading ribbon and said sheet to a second position in which the heat ribbon does not contact the ink ribbon during printing.

* * * * *